US007438290B2

(12) United States Patent
Yahyavi

(10) Patent No.: US 7,438,290 B2
(45) Date of Patent: Oct. 21, 2008

(54) SLIDING SHELL MECHANISM FOR A HOLLOW PUZZLE

(75) Inventor: Mehdi Yahyavi, San Ramon, CA (US)

(73) Assignee: Fourier Idea Inc., San Ramon, CA (US)

( * ) Notice: Subject to any disclaimer, the term of this patent is extended or adjusted under 35 U.S.C. 154(b) by 167 days.

(21) Appl. No.: 11/233,744

(22) Filed: Sep. 23, 2005

(65) Prior Publication Data

US 2006/0066049 A1 Mar. 30, 2006

Related U.S. Application Data

(60) Provisional application No. 60/613,200, filed on Sep. 27, 2004.

(51) Int. Cl.
*A63F 9/08* (2006.01)

(52) U.S. Cl. ..... 273/153 S

(58) Field of Classification Search ..... 273/153 S, 273/157 R, 153 R

See application file for complete search history.

(56) References Cited

U.S. PATENT DOCUMENTS 4,441,715 A * 4/1984 Titus ..... 273/153 S
4,522,401 A * 6/1985 Gustafson ..... 273/153 S
4,557,484 A * 12/1985 Sherman et al. ..... 273/153 S
4,856,786 A * 8/1989 Gyovai ..... 273/153 S
4,865,323 A * 9/1989 Heusinkveld ..... 273/153 S
4,889,340 A * 12/1989 Greene ..... 273/153 S
6,244,597 B1 * 6/2001 Matijek ..... 273/153 S
6,422,559 B1 * 7/2002 Utkin ..... 273/153 S
6,592,122 B2 * 7/2003 Ikenaga ..... 273/153 S
6,857,632 B2 * 2/2005 Tanner ..... 273/153 S

FOREIGN PATENT DOCUMENTS

FR 2515972 A * 5/1983
WO WO 8101638 A * 6/1981

* cited by examiner

*Primary Examiner*—Steven Wong
(74) *Attorney, Agent, or Firm*—Douglas E. Mackenzie

(57) ABSTRACT

A sliding shell mechanism includes a circumferential band, and a pair of portions attachable to the circumferential band, each portion having formed on an edge portion thereof an annular groove, the grooves being sized and configured to slidingly and matingly receive tongue portions of the circumferential band. The disclosed sliding shell mechanism may include additional circumferential bands and provide a hollow interior portion in which electronic circuits may be disposed.

5 Claims, 11 Drawing Sheets

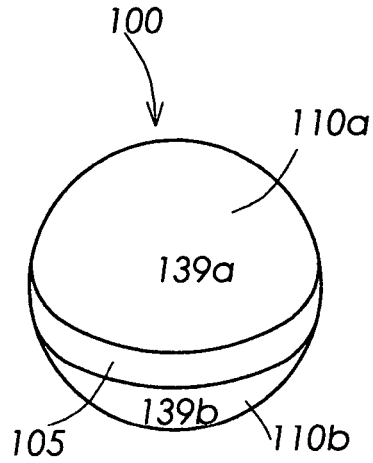
FIG 1.1
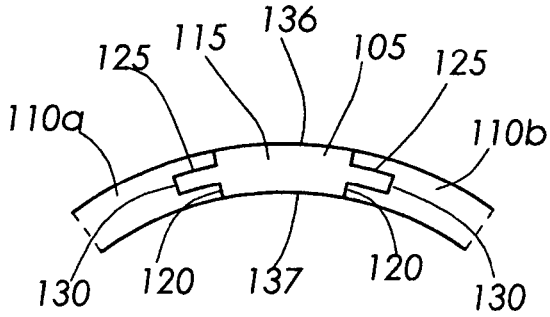
FIG 1.2
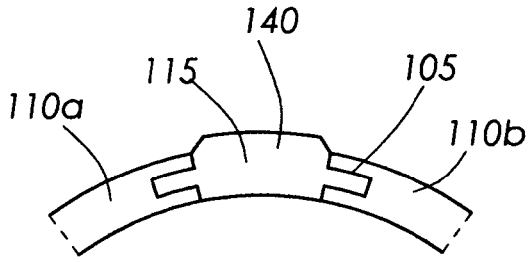
FIG 1.3
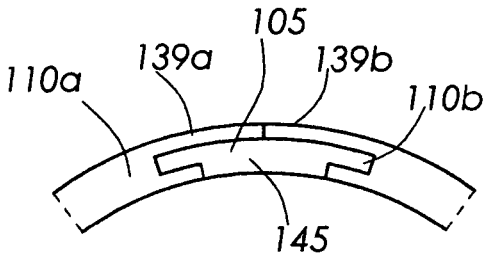
FIG1.4
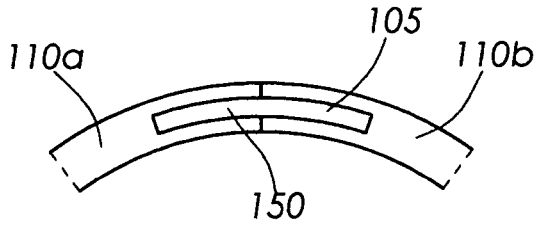
FIG1.5

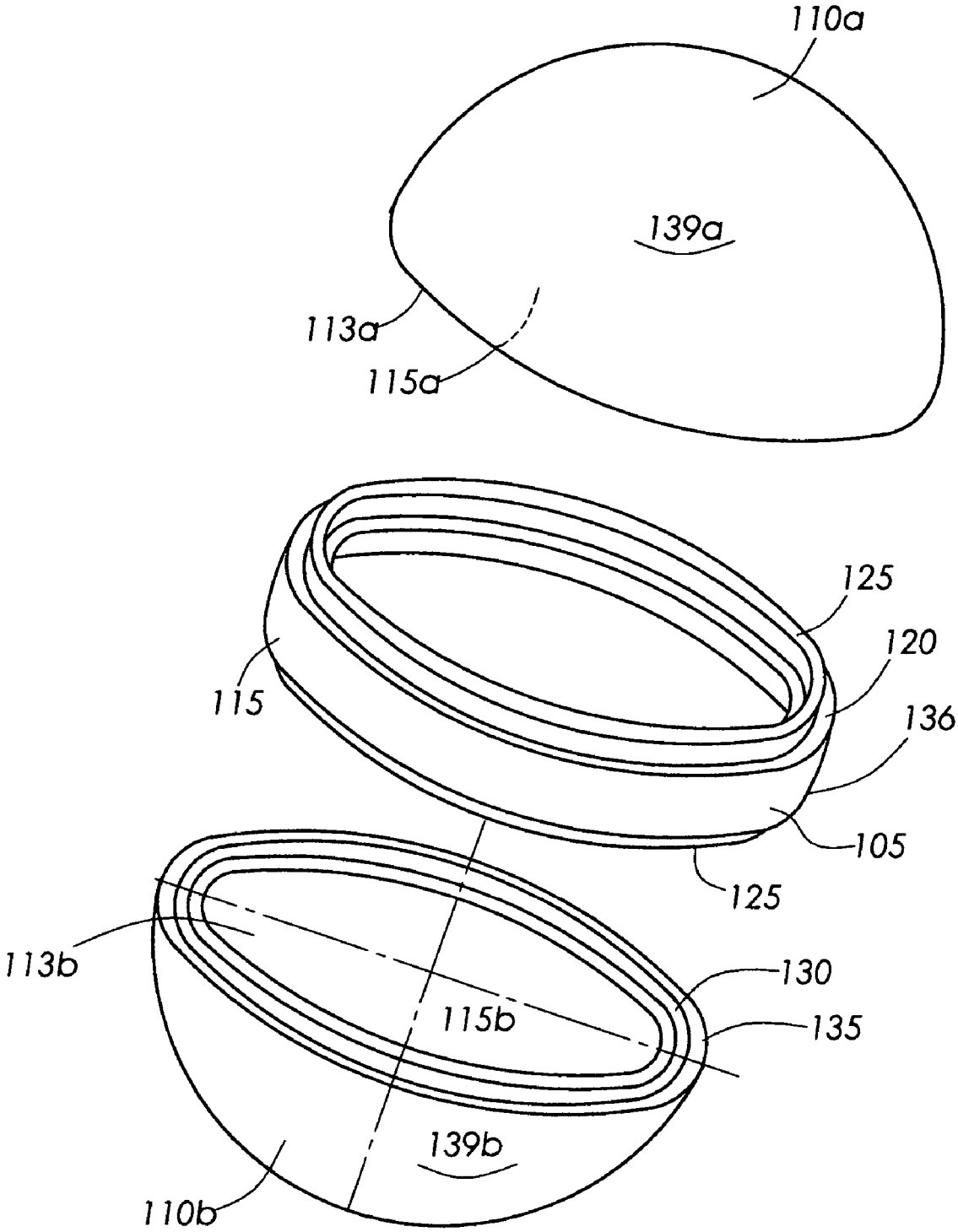
FIG 2.1

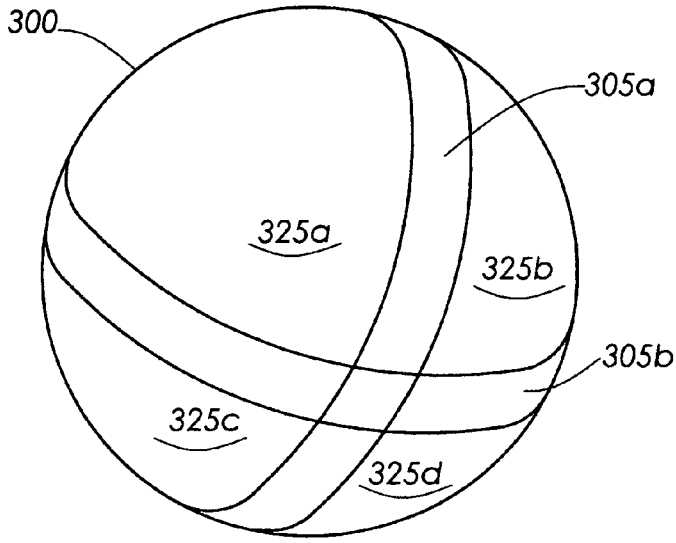
FIG 3.1
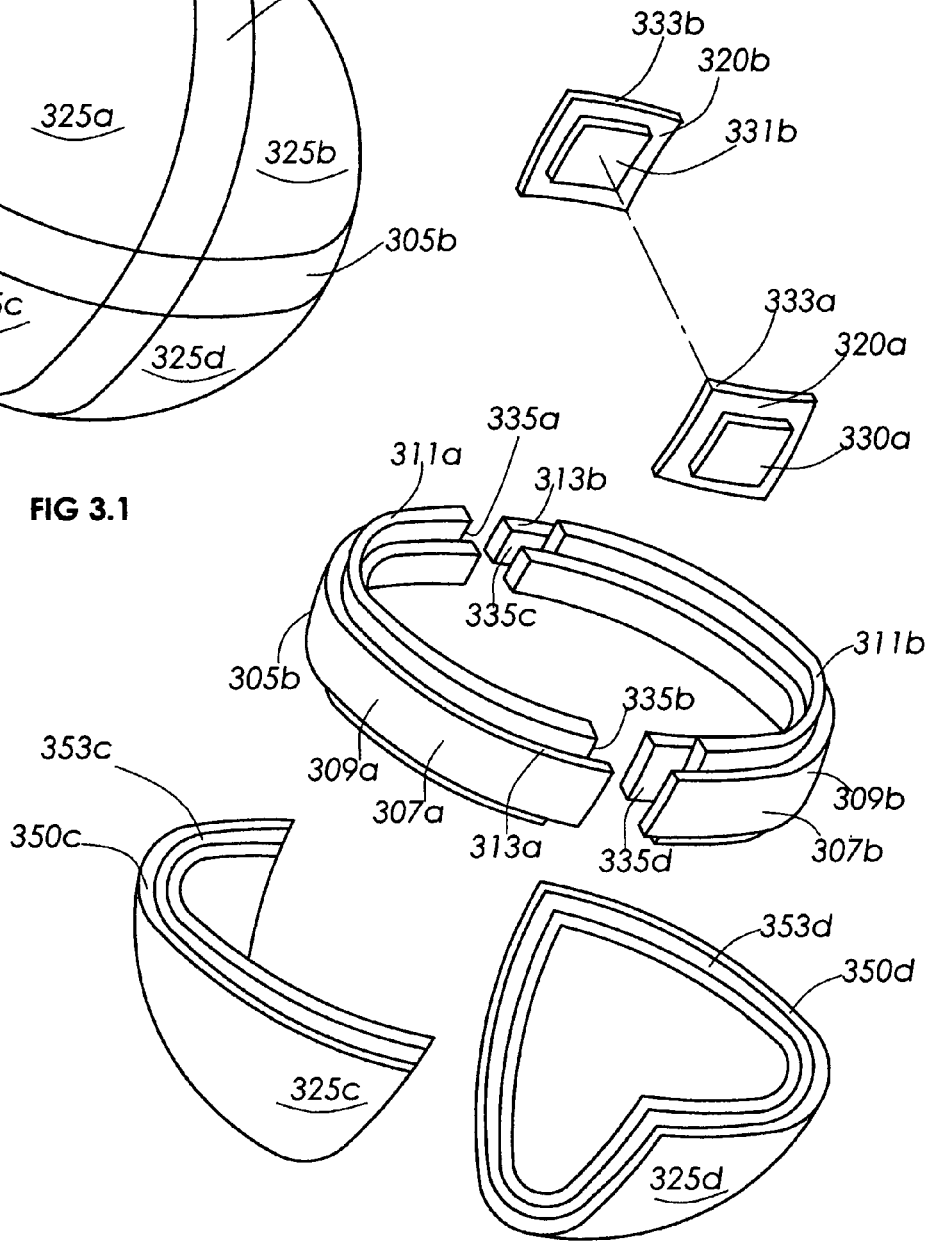
FIG 3.2

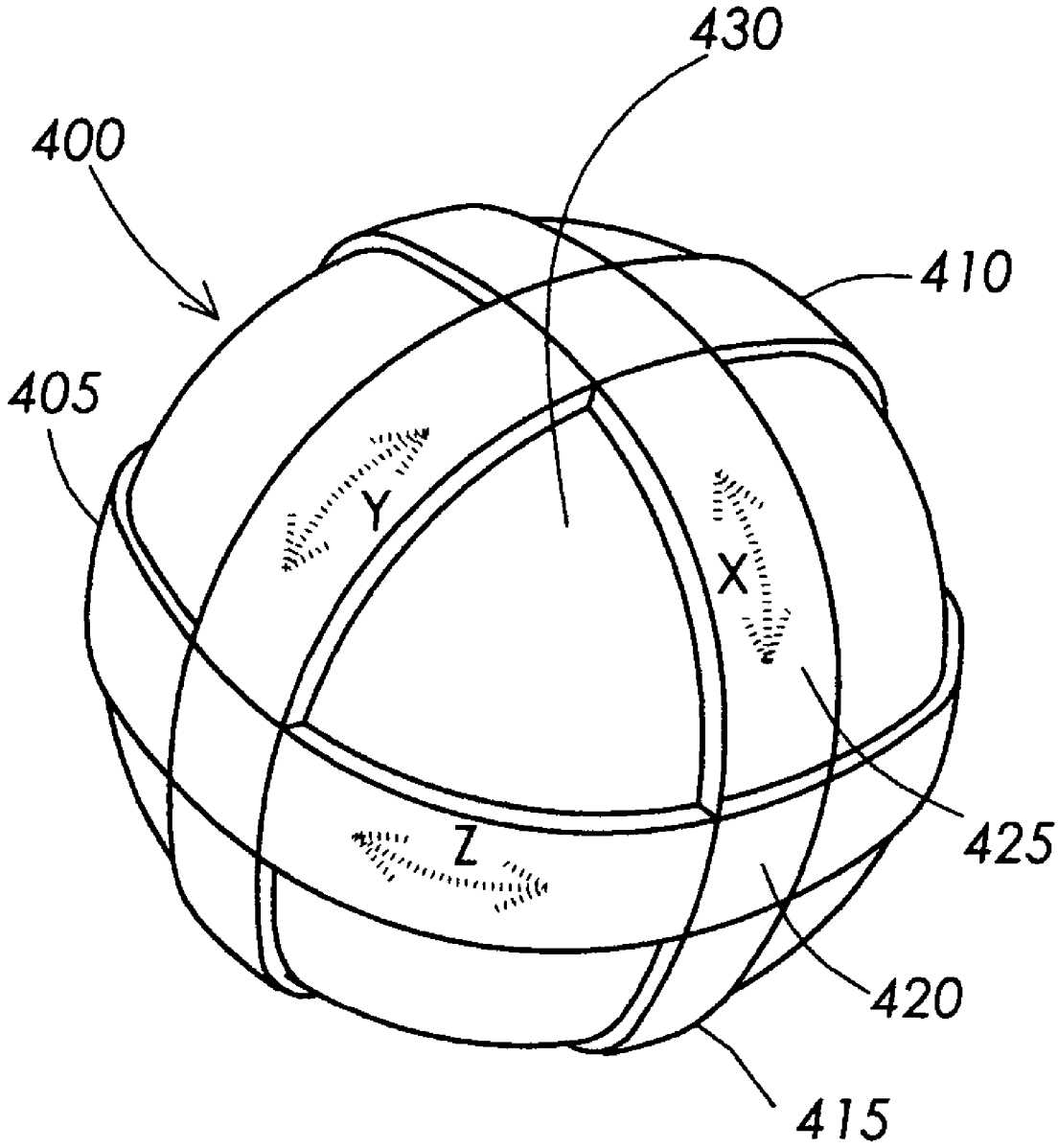
FIG 4.1

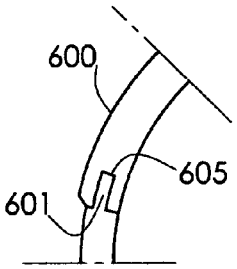
Fig 6.1
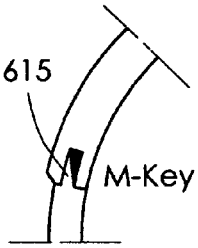
Fig 6.2
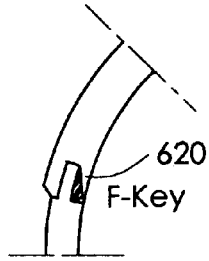
Fig 6.3
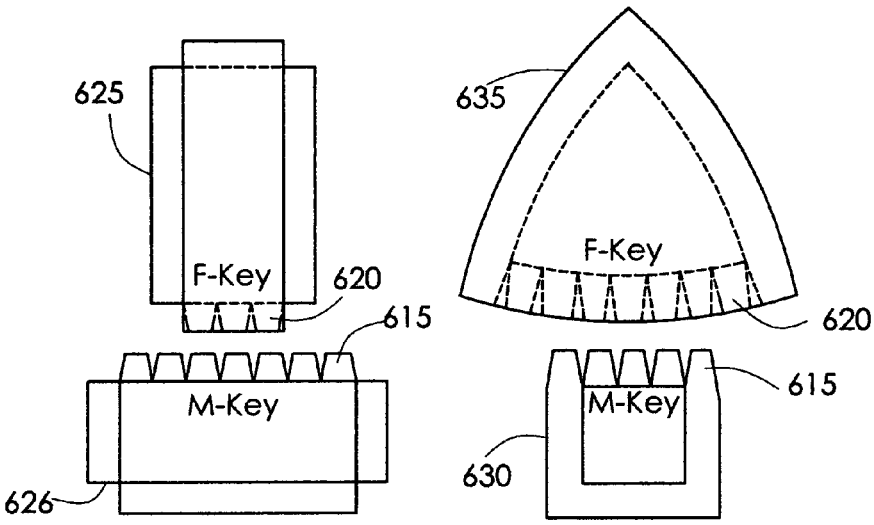
Fig 6-4
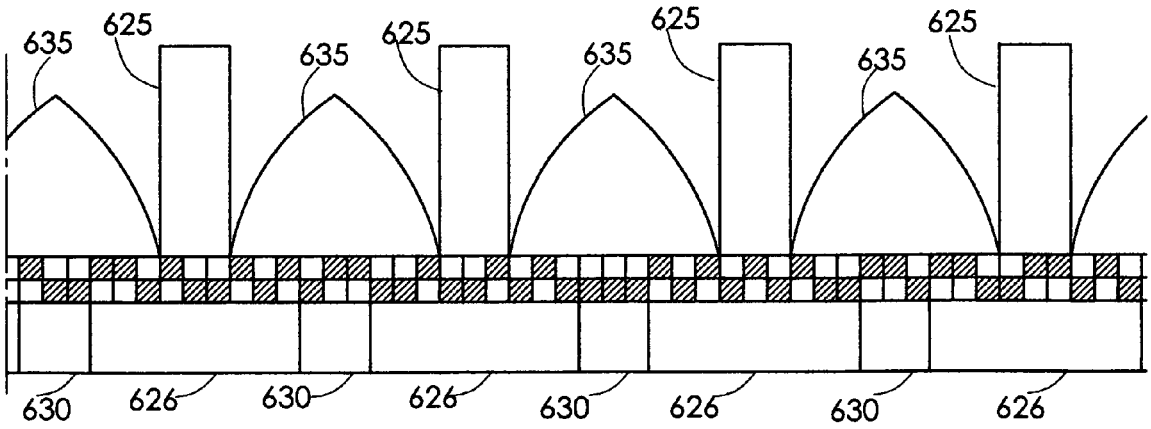
FIG 6.5

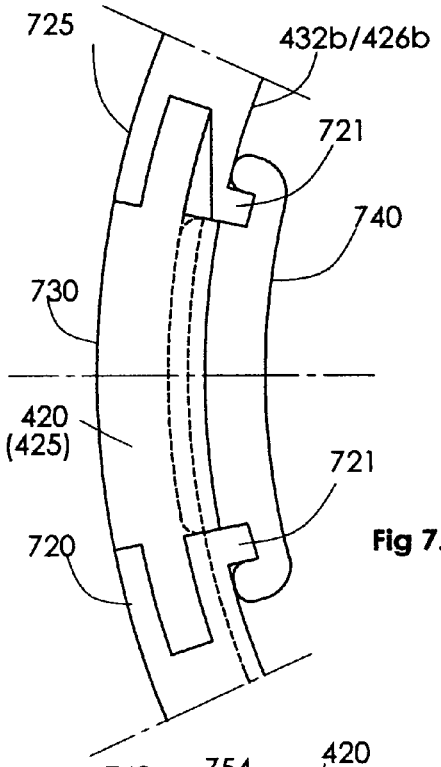
Fig 7.1
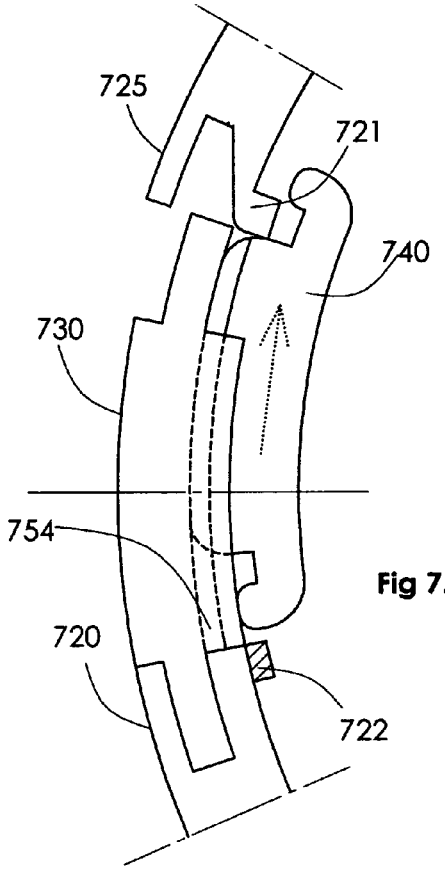
Fig 7.2
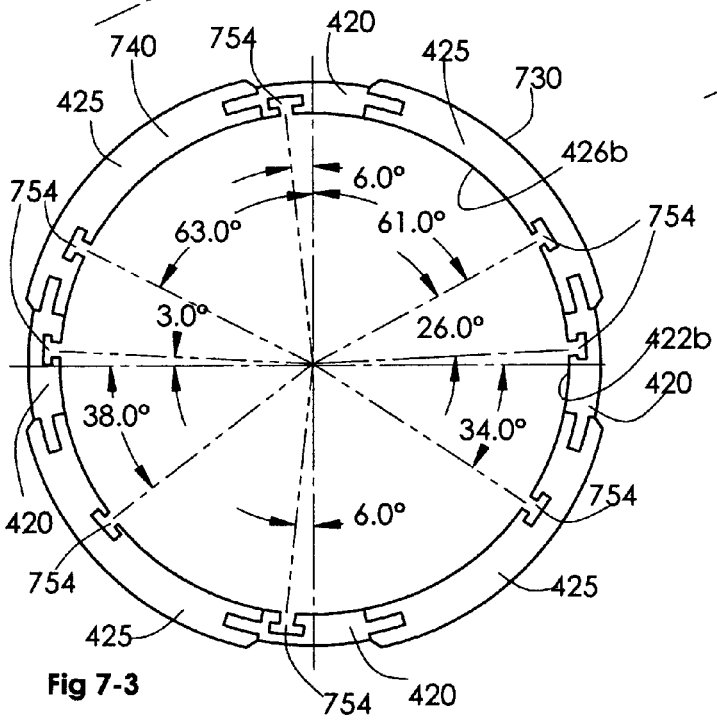
Fig 7-3
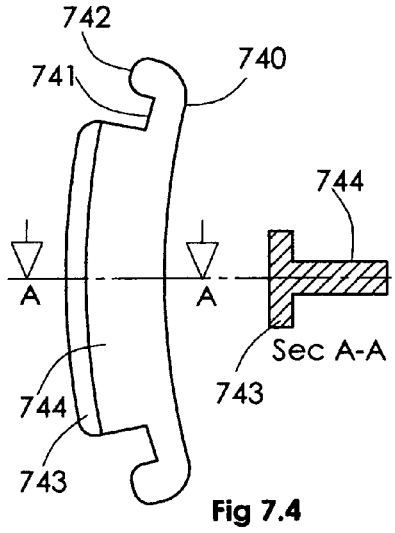
Fig 7.4

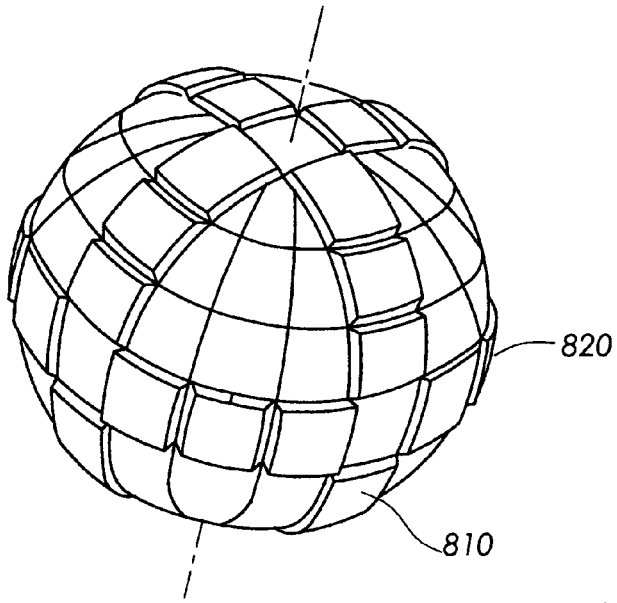
FIG 8.1
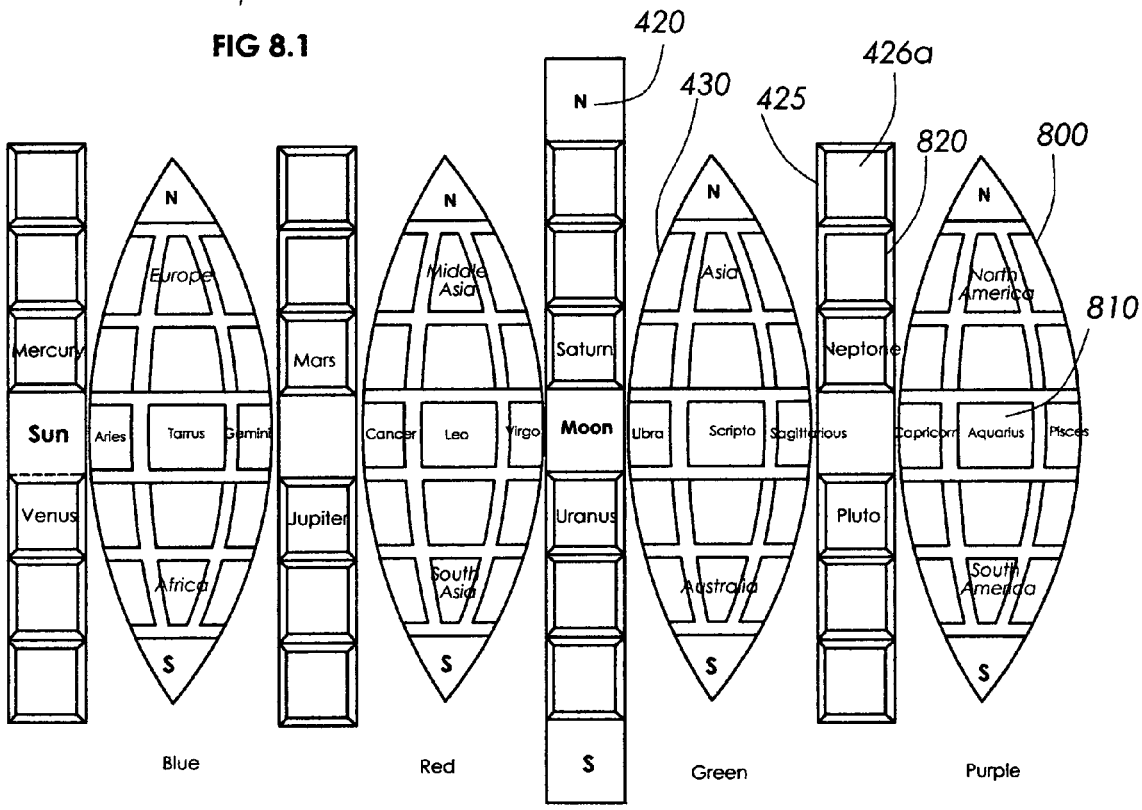
FIG 8.2

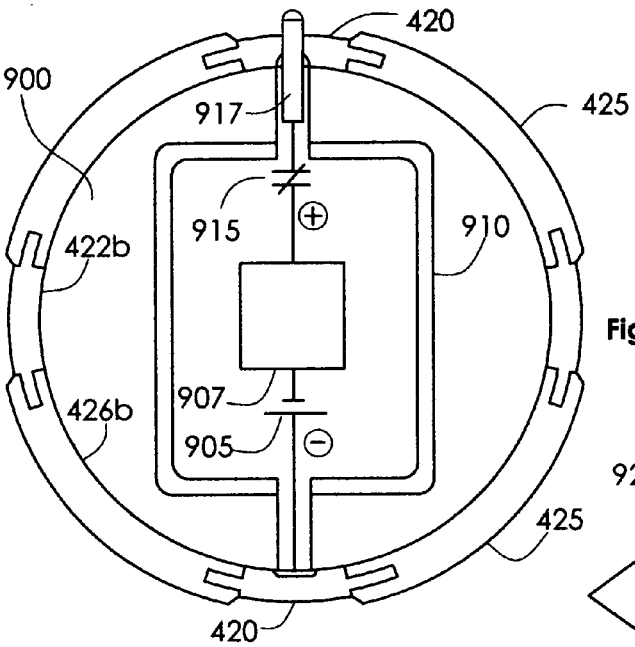
Fig 9.1
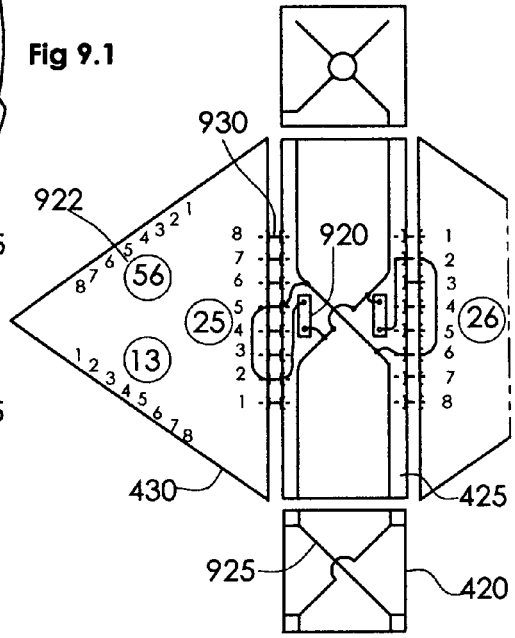
Fig 9.2
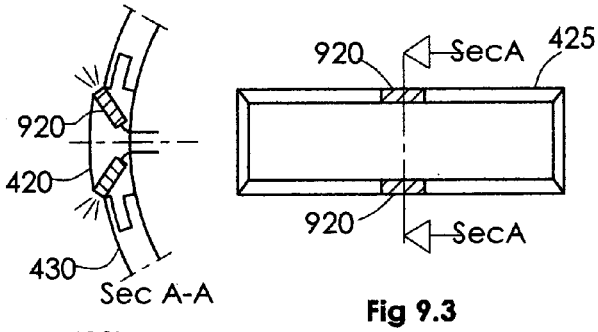
Fig 9.3
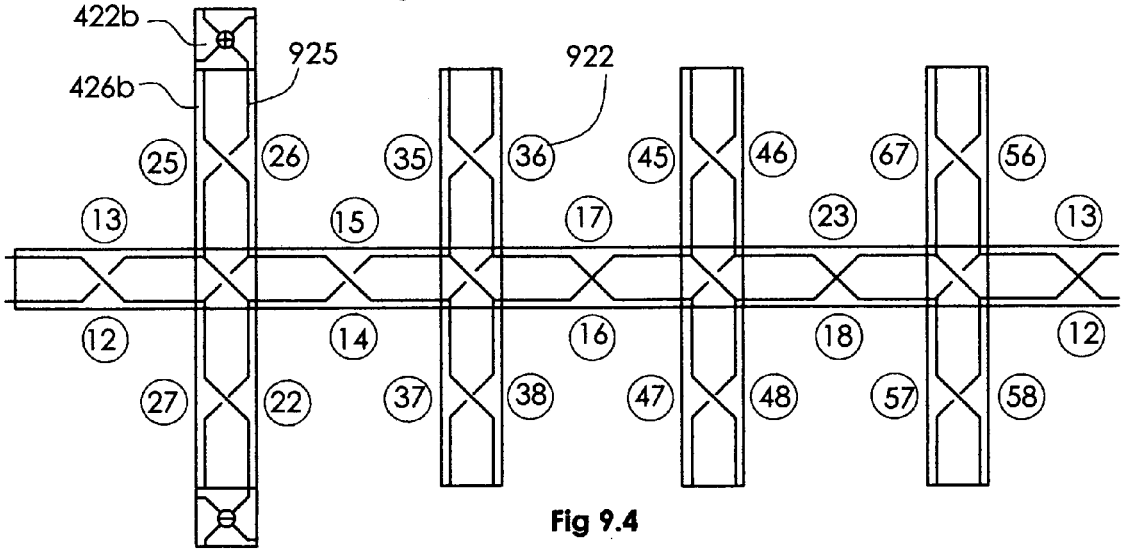
Fig 9.4

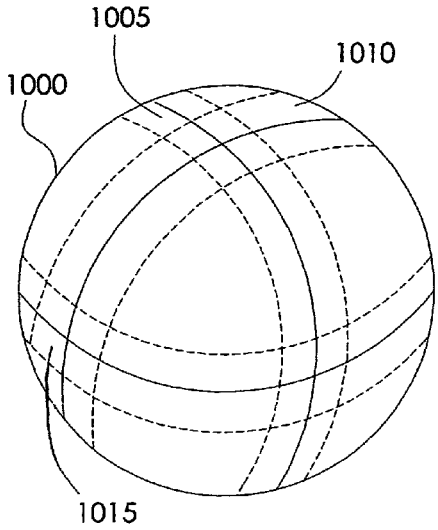
Fig 10.1
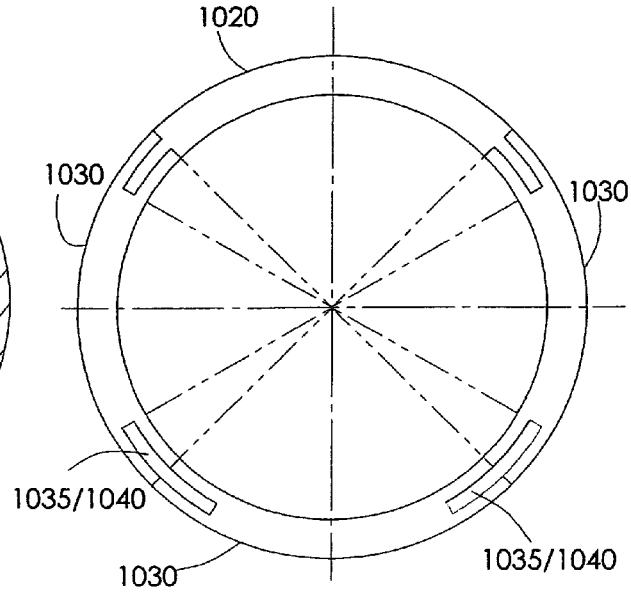
Fig 10.2
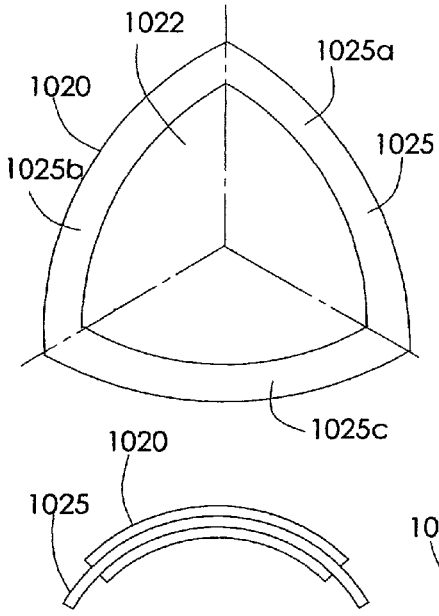
Fig 10.3
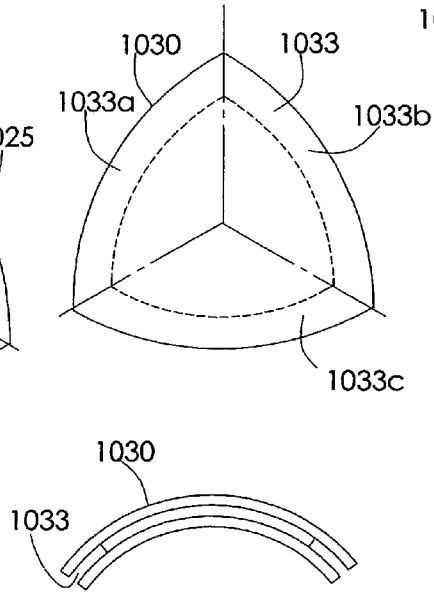
Fig 10.4
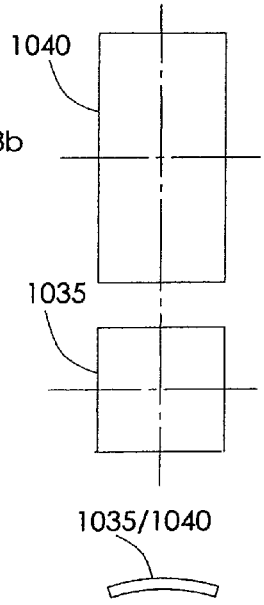
Fig 10.5

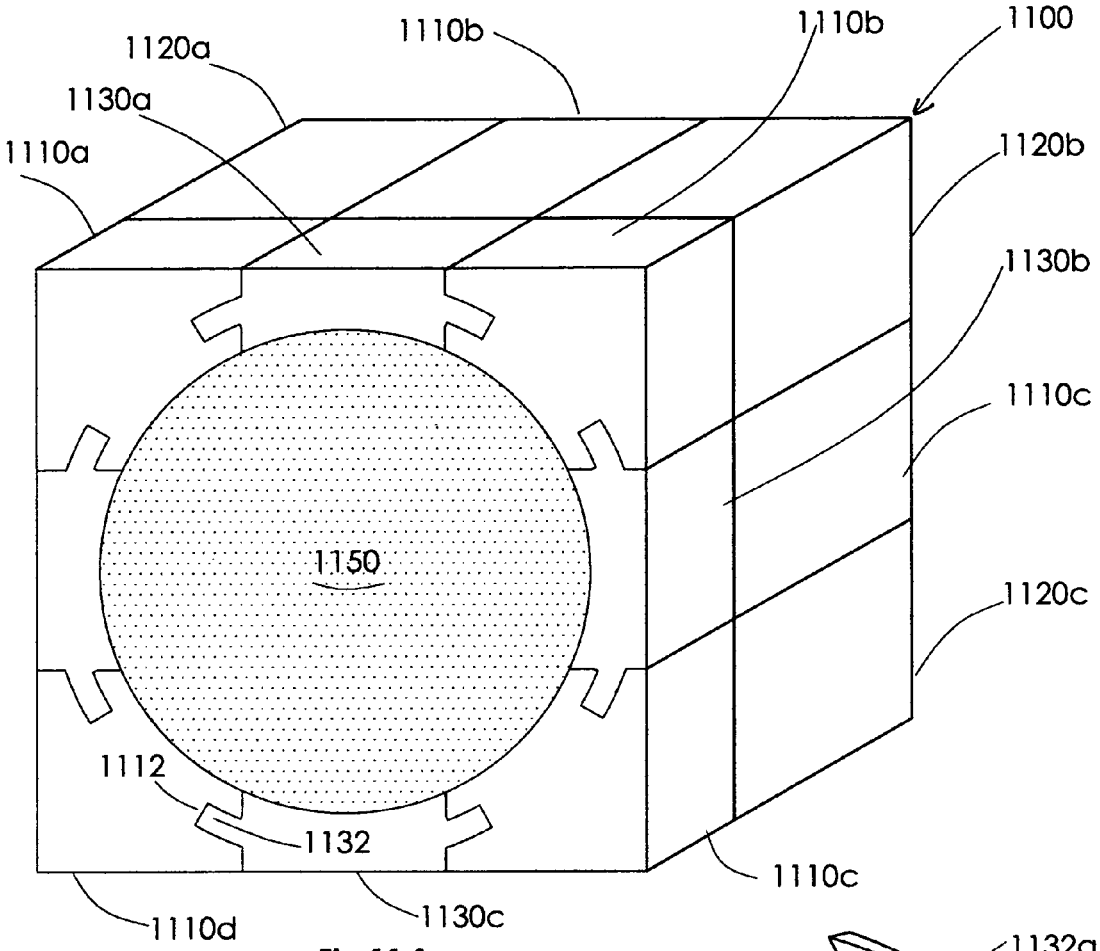
Fig 11.1
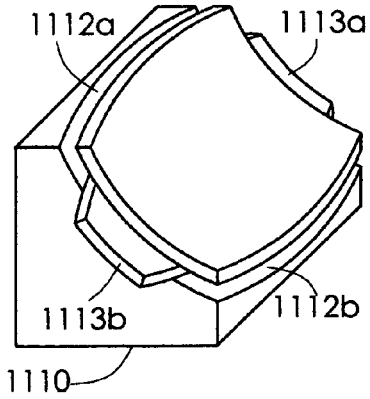
Fig 11.2
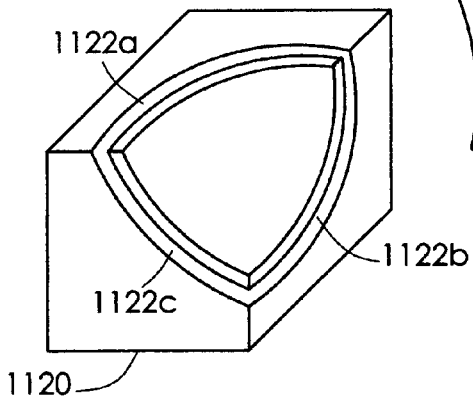
Fig 11.3
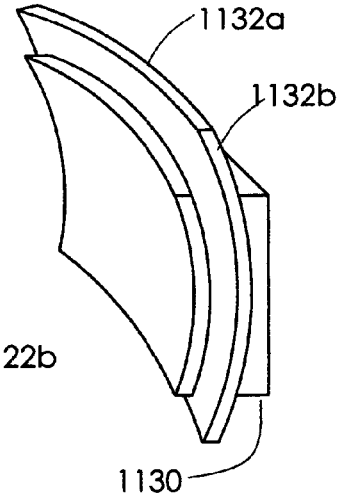
Fig 11.4

SLIDING SHELL MECHANISM FOR A HOLLOW PUZZLE

CROSS REFERENCE TO RELATED APPLICATIONS

The present application claims priority under 35 U.S.C. 119(e) from provisional patent application Ser. No. 60/613,200, entitled "Sliding Shell Mechanism for Starlab and Toopak Games", filed on Sep. 27, 2004, the disclosure of which is herein incorporated by reference in its entirety.

BACKGROUND OF THE INVENTION

The present invention relates generally to games and puzzles and more particularly to a sliding shell mechanism for a hollow puzzle which provides for rotation of surfaces or shells of the hollow puzzle about circumferential bands. The surfaces or shells may be of various contours. The circumferential bands may be either exposed on the surface of the hollow puzzle or hidden within the surface of the hollow puzzle.

In recent years, puzzles such as the Rubik's cube have found commercial success. The Rubik's cube has been developed into different forms and produced in various shapes such as a prism, a pyramid and a globe. The Rubik's cube and its variants however suffer the disadvantage that the components thereof cannot be disassembled and the interiors thereof are not hollow.

Other known prior art puzzles also suffer these disadvantages. A spherical puzzle toy is disclosed in U.S. Pat. No. 5,836,584 and includes a spherical shell which consists of two semi-spherical shells turned on an axis relative to each other, a plurality of partition panels mounted around the spherical shell and defining three intersected tracks around the spherical base along the X, Y and Z axes, and a plurality of slides marked with different marks and moved in the intersected tracks, and wherein the intersected tracks are switched to one another to change the combination of the slides by turning the semi-spherical shells relative to each other. A first semi-spherical shell has a sleeve on an inside at a center thereof. A second semi-spherical shell has a split rod on an inside at a center thereof fitted into the sleeve of the first semi-spherical shell. This arrangement provides for rotation of the first semi-spherical shell relative to the second semi-spherical shell and occupies the interior of the spherical base.

Another spherical puzzle is disclosed in U.S. Pat. No. 5,566,941. The spherical puzzle has two types of surface members positioned around an inner support sphere, wherein the position of each surface member can be moved to the position of any like member. The device may be divided into three sets of opposing domes, with each set of opposing domes being separated by an equatorial band. Thus, both types of surface members can be repositioned by rotating the opposing domes. Further, the domes may be rotated in increments of ninety degrees, after which a different set of domes may be maneuvered. Although the puzzle includes a structure for complete disassembly and reassembly by the user, the inner support sphere does not provide for an accessible hollow interior portion.

A spherical mechanical puzzle is disclosed in U.S. Pat. No. 5,074,562 including a plurality of separately identifiable puzzle pieces that are hand manipulated over tracks formed in a spherical base member of the puzzle. Three continuous and mutually perpendicular equatorial tracks are formed in the surface of the puzzle base member dividing the base member into eight separate surface sections, each surface section having a different color. The plurality of puzzle pieces are mounted on the three tracks for sliding movement along the tracks, and each of the puzzle pieces is divided into four segments or two segments having identifying colors that correspond to the colors of the base member surface sections. The mechanical puzzle is solved by hand manipulating the puzzle pieces over the three tracks to positions on the tracks where each of the puzzle pieces is positioned adjacent surface sections having the same colors as the puzzle pieces. The base member does not provide for an accessible hollow interior portion.

There is therefore a need in the art for a sliding shell mechanism for a hollow puzzle that overcomes the disadvantages of the prior art. The sliding mechanism preferably provides for a puzzle that includes an accessible hollow space therewithin. The sliding mechanism preferably also provides for a puzzle that is capable of being disassembled. The sliding mechanism further preferably provides for a puzzle that can be reassembled.

SUMMARY OF THE INVENTION

In one aspect of the invention, a sliding shell mechanism provides a hollow spherical puzzle having three exposed circumferential bands about which six hemispherical surfaces may be rotated. Each hemispherical surface may be comprised of a portion of two orthogonal exposed circumferential bands together with four triangular surface pieces. Eight triangular surface pieces disposed between portions of each of the three exposed circumferential bands, together with the circumferential bands, may form the spherical puzzle. Indicia formed on the exposed circumferential bands and the triangular surface pieces may be arranged in a completed arrangement to enable disassembling the spherical puzzle to reveal a hollow portion therewithin.

In another aspect of the invention, a sliding shell mechanism provides a hollow spherical puzzle having three hidden circumferential bands upon which six hemispherical surfaces may be rotated. Each hemispherical surface may be comprised of four triangular surface pieces. Eight triangular surface pieces may form the surface of the spherical puzzle. Indicia formed on the triangular surface members may be arranged in a completed arrangement to provide a challenging spherical puzzle.

In another aspect of the invention, a sliding shell mechanism includes a pair of circumferential bands and four portions attachable to the circumferential bands, each portion having formed on an edge portion thereof a groove, the grooves being sized and configured to slidingly and matingly receive tongue portions of the circumferential bands.

In yet another aspect of the invention, a sliding shell mechanism includes three circumferential bands, four connection portions, and eight portions attachable to the circumferential bands and connection portions, each of the eight portions having formed on an edge portion thereof a groove, the grooves being sized and configured to slidingly and matingly receive tongue portions of the circumferential bands and the connection portions.

In yet another aspect of the invention, a sliding shell mechanism includes three circumferential bands, four connection portions, and eight portions attachable to the circumferential bands and connection portions, each of the eight portions having formed on an edge portion thereof an annular groove, the grooves being sized and configured to slidingly and matingly receive tongue portions of the circumferential bands and the connection portions.

There has been outlined, rather broadly, the more important features of the invention in order that the detailed description thereof that follows may be better understood, and in order that the present contribution to the art may be better appreciated. There are, of course, additional features of the invention that will be described below and which will form the subject matter of the claims appended herein.

In this respect, before explaining at least one embodiment of the invention in detail, it is to be understood that the invention is not limited in its application to the details of design and to the arrangement of the components set forth in the following description or illustrated in the drawings. The invention is capable of other embodiments and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other methods and systems for carrying out the several purposes of the present invention. It is important, therefore, that the claims be regarded as including such equivalent methods and systems insofar as they do not depart from the spirit and scope of the present invention.

BRIEF DESCRIPTION OF THE DRAWINGS

The present disclosure may be better understood and its numerous features and advantages made apparent to those skilled in the art by referencing the accompanying drawings.

FIG. 1.2 is a partial cross section showing a section of an exposed circumferential band in accordance with the invention;

FIG. 1.3 is a partial cross section showing a section of an alternative exposed circumferential band in accordance with the invention;

FIG. 1.4 is a partial cross section showing a section of a hidden circumferential band in accordance with the invention;

FIG. 1.5 is a partial cross section showing a section of an alternative hidden circumferential band in accordance with the invention;

FIG. 3.1 is a perspective view of a second embodiment of the sliding shell mechanism in accordance with the invention;

FIG. 3.2 is a partial exploded view of the sliding shell mechanism of FIG. 3.1;

FIG. 4.1 is a perspective view of a third embodiment of the sliding shell mechanism in accordance with the invention;

FIG. 5.2 is a fragmented cross sectional view along a circumferential band of the sliding shell mechanism of FIG. 4.1 in accordance with the present invention;

FIG. 6.1 is a cross sectional view of a normal junction of the third embodiment of the sliding shell mechanism in accordance with the invention;

FIG. 6.2 is a cross sectional view of an M-key junction of the third embodiment of the sliding shell mechanism in accordance with the invention;

FIG. 6.3 is a cross sectional view of an F-key junction of the third embodiment of the sliding shell mechanism in accordance with the invention;

FIG. 6.4 is a plan view of the surface members having either F-key or M-key fingers of the third embodiment of the sliding shell mechanism in accordance with the invention;

FIG. 6.5 is a graphical representation showing the alignment of the finger keys of the third embodiment of the sliding shell mechanism in accordance with the invention;

FIG. 7.1 is a cross sectional view of a sliding latch in a locked position of the third embodiment of the sliding shell mechanism in accordance with the invention;

FIG. 7.2 is a cross sectional view of the sliding latch in an unlocked position of the third embodiment of the sliding shell mechanism in accordance with the invention;

FIG. 7.3 is a cross sectional view showing an arrangement of the sliding latches over a locking circumferential band of the third embodiment of the sliding shell mechanism in accordance with the invention;

FIG. 7.4 shows side and cross sectional views of the sliding latch of the first embodiment of the sliding shell mechanism in accordance with the invention;

FIG. 8.1 is a perspective view of the third embodiment of the sliding shell mechanism showing relief sections on the surface of the sliding shell mechanism in accordance with the invention;

FIG. 8.2 is a diagram of a surface configuration and color scheme of the third embodiment of the sliding shell mechanism in accordance with the invention;

FIG. 9.1 is a cross sectional view of the third embodiment of the sliding shell mechanism showing an electrical box in accordance with the invention;

FIG. 9.2 is a schematic representation of representative circuit connections of the third embodiment of the sliding shell mechanism showing an electrical circuit in accordance with the invention;

FIG. 9.3 shows plan and cross sectional views of the rectangular surface member of the third embodiment of the sliding shell mechanism having light emitting diodes in accordance with the invention;

FIG. 9.4 is a schematic representation of a bus arrangement and contact code of the first embodiment of the sliding shell mechanism showing an electrical circuit in accordance with the invention;

FIG. 10.1 is a perspective view of a fourth embodiment of the sliding shell mechanism in accordance with the invention;

FIG. 10.2 is a cross sectional view of a circumferential band of the fourth embodiment of the sliding shell mechanism in accordance with the invention;

FIG. 10.3 is a plan and side elevation view of a flanged triangular surface piece of the fourth embodiment of the sliding shell mechanism in accordance with the invention;

FIG. 10.4 is a plan and side elevation view of a slotted triangular surface piece of the fourth embodiment of the sliding shell mechanism in accordance with the invention;

FIG. 10.5 is a plan and side elevation view of square and rectangular pieces of the circumferential band of the fourth embodiment of the sliding shell mechanism in accordance with the invention;

FIG. 11.1 is a cross sectional view of a fifth embodiment of the sliding shell mechanism in accordance with the invention;

FIG. 11.2 is a perspective view of an edge element of the fifth embodiment of the sliding shell mechanism in accordance with the invention;

FIG. 11.3 is a perspective view of a vertex element of the fifth embodiment of the sliding shell mechanism in accordance with the invention; and FIG. 11.4 is a perspective view of a side element of the fifth embodiment of the sliding shell mechanism in accordance with the invention.

DETAILED DESCRIPTION OF THE INVENTION

Figures 1, 5:
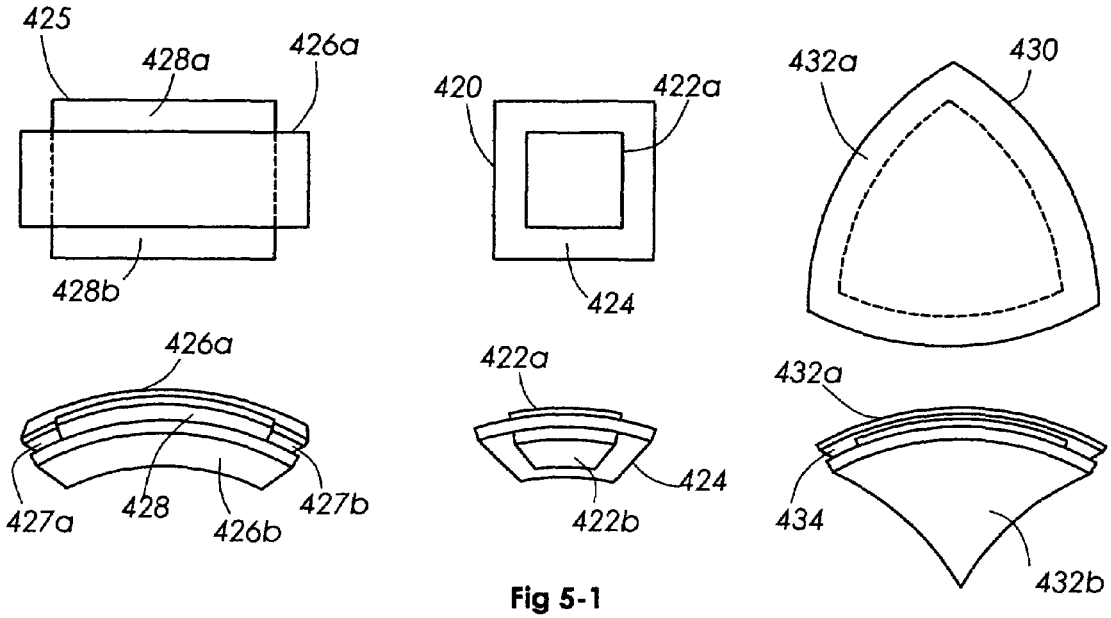
FIG. 1.1 is a perspective view of a first embodiment of the sliding shell mechanism in accordance with the invention.
FIG. 5.1 shows plan and perspective views of the surface members of the third embodiment of the sliding shell mechanism in accordance with the present invention.
Figures 2, 5:
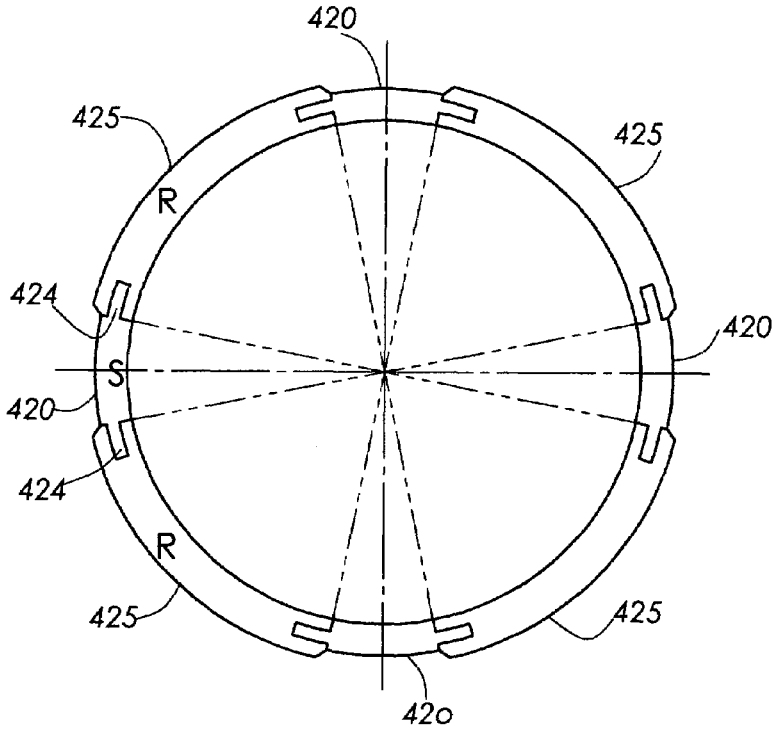
FIG. 2.1 is an exploded view of the sliding shell mechanism of FIG. 1.1.

In a first embodiment of the present invention, a sliding shell mechanism provides a hollow puzzle generally designated 100 having an exposed circumferential band 105 as shown in FIG. 1.1. Circumferential band 105 may provide connection and rotation between a first partial hemispherical portion 110*a* and a second partial hemispherical portion 110*b*. First and second partial hemispherical portions 110*a* and 110*b* may provide hollow interiors 113*a* and 113*b* respectively as shown in FIG. 2.1.

Circumferential band 105 may include an annular band 115 having formed on midlines of edges 120 thereof flanges 125. Flanges 125 may be slidingly and matinlgy received in slots or grooves 130 formed on edges 135 of first and second partial hemispherical portions 110*a* and 110*b*. Flanges 125 and grooves 130 provide for rotation of first and second partial hemispherical portions 110*a* and 110*b* about circumferential band 105 and for rotation of first and second partial hemispherical portions 110*a*, 110*b* and circumferential band 105 relative to each other.

While the first embodiment of the invention has been described as having first and second partial hemispherical portions 110*a* and 110*b*, one skilled in the art will recognize that other shapes are within the scope of the invention. A plurality of shapes capable of having an annular groove formed therein for sliding and mating engagement with circumferential band 105 are contemplated. This property holds true for the various embodiments of the invention described herein.

In one aspect of the invention, circumferential band 105 may be exposed as shown in FIG. 1.2. Annular band 115 may include an exterior surface 136 and an interior surface 137. In similar fashion, first and second partial hemispherical portions 110*a* and 110*b* may include exterior surfaces 139*a* and 139*b* respectively. As shown, the annular band 115 is exposed on the exterior surface 135 which is disposed adjacent and between the exterior surfaces 139*a* and 139*b* of the pair of portions 110*a* and 110*b*.

In another aspect of the invention, annular band 115 may include a raised relief section 140 as shown in FIG. 1.3. Raised relief section 140 may provide for a means by which the circumferential band 105 and first and second partial hemispherical portions 110*a* and 110*b* may be more easily manually rotated with respect to each other.

In yet another aspect of the invention, an annular band 145 may be disposed beneath the exterior surfaces 139*a* and 139*b* of the pair of portions 110*a* and 110*b*. As shown in FIG. 1.4, the exterior surfaces 139*a* and 139*b* may be disposed adjacent one another. In contrast to annular band 115, annular band 145 has a flattened "T" cross section.

An annular band 150 may be disposed between the exterior surfaces 139*a* and 139*b* and interior surfaces 115*a* and 115*b* (FIG. 2.1) of first and second portions 110*a* and 110*b* respectively in another aspect of the invention. As shown in FIG. 1.5, annular band 150 has a laminar cross section.

The present invention includes circumferential bands 105 of various configurations to provide for embodiments having exposed and hidden annular bands. These embodiments provide for puzzles of different appearances and configurations. Manipulation of the puzzles is determined in part upon the disposition of the circumferential bands 105, either exposed or hidden.

In a second embodiment of the present invention, a sliding shell mechanism provides a hollow spherical puzzle 300 having two circumferential bands 305*a* and 305*b* as shown in FIG. 3.1. Provision of two circumferential bands 305*a* and 305*b* allows for two axes of rotation which may be described in Cartesian terms as the x-axis and the y-axis.

With reference to FIG. 3.2, circumferential band 305*b* is shown including a first portion 307*a* and a second portion 307*b*. First portion 307*a* may include a portion 309*a* and a flange portion 311*a* disposed at a midline of an edge portion 313*a* of the portion 309*a*. In similar fashion, second portion 307*b* may include a portion 309*b* and a flange portion 311*b* disposed at a midline of an edge portion 313*b* of the portion 309*b*. A pair of connecting sections 320*a* and 320*b* may provide for alternate rotation of pairs of partial semi-hemispherical portions 325*a*, 325*b*, 325*c* and 325*d* about circumferential bands 305*a* and 305*b*.

Connecting section 320*a* may include outside center portion 330*a* having formed therearound a flange portion 333*a*. An inside center portion is not shown. Connecting section 320*b* may include an inside portion 331*b* having formed therearound a flange portion 333*b*. An outside center portion is not shown. Flange portions 333*a* and 333*b* may be slidingly and matingly received in groove portions 335*a* and 335*b*, and 335*c* and 335*d* formed in portions 309*a* and 309*b* respectively.

Circumferential band 305*a* may be constructed in a manner similar to circumferential band 305*b* and include portions having groove portions. In any configuration of the hollow spherical puzzle 300, connecting sections 320*a* and 320*b* may be slidingly and matingly received in the groove portions of both circumferential band 305*a* and circumferential band 305*b* to thereby provide alternatively x-axis rotation and y-axis rotation.

Exemplary partial semi-hemispherical portions 325*c* and 325*d* are shown in FIG. 3.2 and may include edge portions 350*c* and 350*d* respectively. Edge portions 350*c* and 350*d* may include a groove 353*c* and 353*d* respectively formed therein for receiving flange portions including tongue portion 311*a* and flange portion 311*b* and flange portions 333*a* and 333*b*. Partial semi-hemispherical portions 325*a*, 325*b*, 325*c* and 325*d* may have spherical outside and inside surfaces. Alternative surface configurations may also be provided.

In a third embodiment of the present invention, a sliding shell mechanism provides a hollow spherical puzzle generally designated 400 having three exposed circumferential bands 405, 410 and 415 as shown in FIG. 4.1. Exposed circumferential bands 405, 410 and 415 may be disposed orthogonally to each other. Circumferential band 405 may be rotatable about a z-axis, circumferential band 410 may be rotatable about a y-axis, and circumferential band 415 may be rotatable about an x-axis.

Each of circumferential bands 405, 410 and 415 may include four square surface pieces 420 and four rectangular surface pieces 425 (FIG. 5.1) arranged in alternate fashion as shown in FIG. 5.2. Each circumferential band 405, 410 and 415 may share a pair of square surface pieces 420 with a circumferential band orthogonal thereto. In this manner, the circumferential bands 405, 410 and 415 may include twelve rectangular surface pieces 425 and six square surface pieces 420. The surface of the spherical puzzle 400 may be completed with eight triangular surface pieces 430 (FIG. 5.1) disposed between the circumferential bands 405, 410 and 415 for a total of twenty six surface pieces. In this manner, six partial hemispherical surfaces may be formed with each circumferential band 405, 410 and 415 defining two partial hemispherical surfaces.

The square surface pieces 420, rectangular surface pieces 425 and triangular surface pieces 430 may be curved to conform to the spherical shape of the spherical puzzle 400 as shown in FIG. 5.1. Each square surface piece 420 may include an outside body portion 422*a*, an inside body portion 422*b*, and a flange portion 424 of rectangular configuration. Each rectangular surface piece 425 may include an outside body portion 426*a*, an inside body portion 426*b*, flange portions 428*a* and 428*b* disposed opposite each other, and slots 427*a* and 427*b* disposed opposite each other. Slots 427*a* and 427*b* may be sized and configured to slidingly and matingly receive flange 424 as shown in FIG. 5.2. Each triangular surface piece 430 may include an outside body portion 432*a* and an inside body portion 432*b*. A slot 434 may be formed between the outside body portion 432*a* and the inside body portion 432*b*. Slot 434 may be sized and configured to slidingly and matingly receive flange portion 424 and flange portions 428*a* and 428*b* as the hemispherical surfaces rotate about the circumferential bands 405, 410 and 415.

In order to provide the spherical shape of the spherical puzzle 400, a width of the outside body portion 426*a* of each rectangular surface piece 425 may be equal to the length of a side of the outside body portion 422*a* of each square surface piece 420. In addition, a length of the outside body portion 432*a* of each triangular surface piece 430 may be equal to a length of the outside body portion 426*a* of each rectangular surface piece 425. In this manner, the outside body portions 422*a*, 426*a* and 432*a* may be aligned as shown in FIG. 4.1 to form the spherical shape of the spherical puzzle 400.

With particular reference to FIG. 5.2, connection between the square surface pieces 420 and the rectangular surface pieces 425 may be achieved by male/female sliding joints. These male/female sliding joints may include sliding and mating engagement between flange portion 424 and slots 427*a* and 427*b*. Additional male/female sliding joints may include sliding engagement between flange portions 428*a* and 428*b* and slot 434.

In a preferred embodiment of the spherical puzzle 400, the inner radius of the spherical puzzle 400 may be 40 mm. The overall thickness of each square surface piece 420 and each triangular surface piece 430 may be 5 mm. The overall thickness of each rectangular surface piece 425 may be 6.5 mm to facilitate manual rotation of the hemispherical surfaces.

A locking mechanism may be provided to facilitate the assembly and disassembly of the spherical puzzle 400. Without the locking mechanism, the spherical puzzle 400 may only be easily assembled and disassembled if the surface pieces 420, 425 and 430 are manufactured from a flexible material such as polyethylene. If less flexible materials are used, the spherical puzzle 400 may not be easily assembled and disassembled.

With reference to FIG. 6.1, a previously described male/female sliding joint 600 is shown. A flange 605 may be received in a slot 610. The curvature of flange 605 and slot 610 may provide a latch which prevents the flange 605 from easily escaping the slot 610.

A locking mechanism in accordance with the invention may be provided by cutting the flange 605 to provide a male key 615 (the cut area is represented by the thatched area in FIG. 6.2) and by cutting the slot 610 to provide a female key 620 (FIG. 6.3). A plurality of finger keys including male keys 615 and female keys 620 may be provided in the square surface pieces 630, the rectangular surface pieces 625, and the triangular surface pieces 635 disposed at one edge of a selected one of the circumferential bands 405, 410 and 415 (FIG. 4.1). As shown in FIG. 6.4, a selected circumferential band may comprise four rectangular surface pieces 626 including seven male keys 615 each and four square surface pieces 630 including five male keys 615 each. The opposing hemisphere may comprise four triangular surface pieces 635 including nine female keys 620 each and four rectangular surface pieces 625 including three female keys 620 each. These pieces may be disposed at one edge of the selected circumferential band to provide the locking mechanism.

The locking mechanism enables the hemispherical surfaces disposed about the selected circumferential band to be disassembled one from the other in the case where all male keys 615 are aligned with an uncut slot portion 601 and all female keys 620 are aligned with uncut flange portions 605. As will be appreciated by one skilled in the art, such a locking mechanism may be thought of as a digital-mechanical lock in which the male keys 615 and female keys 620 may be represented by one and the uncut flange portions 605 and uncut slot portions 601 represented by zero. The locking mechanism will unlock in an arrangement in which the sum of any two aligned male keys 615, female keys 620 and uncut slot portions 601 and uncut flange portions 605 respectively equals one. Such an arrangement may include a digital-mechanical unlocking code. One such arrangement is shown in FIG. 6.5 in which the thatched areas equal to one, indicating finger key positions.

The locking mechanism of the invention involves only seventeen surface pieces including the selected circumferential band surface pieces. The nine remaining surface pieces are not involved in the locking mechanism and therefore a player of the spherical puzzle 400 need not align the nine surface pieces in order to unlock the locking mechanism. The feature makes the spherical puzzle 400 easier to solve than the Rubik's cube.

In another aspect of the invention, a sliding latch locking mechanism shown in FIGS. 7.1, 7.2, 7.3 and 7.4 may include a symmetrical sliding latch 740 which has a sliding portion 743 and a latching portion 744. Eight sliding latches 740 may be disposed at positions on inside surfaces 422*b* of element 420 and 426*b* of elements 425 located on the same circumferential band that includes the finger key system. These particular square or rectangular elements 420 and 425 are provided with sliding slots 754 to locate the sliding portion 743 of the sliding latches 740 as shown in FIG. 7.3. The inside edges of all triangular elements 432*b* and the shorter sides of the rectangular elements 426*b* may be provided with a latching flange 721 that travels inside a latching slot 741 of the sliding latch 740 in normal rotations as shown in FIG. 7.1. As shown in FIG. 7.2, these latching flanges include partial cuts 722 in eight certain positions corresponding to the arrangement of sliding latches shown in FIG. 7.3. In locked position as shown in FIG. 7.1, the latching flange 721 prevents the sliding latch 740 from moving up thus preventing the lifting up of the upper hemisphere 725 even when all finger keys are in the unlocked position. However, when all surface elements of the lower hemisphere 720 are in the right position, then the cut portions 722 give way to the sliding element 740 to move upwards while the sliding latches 742 are pulled up by the latch flange 721 to release the upper hemisphere 725.

With reference to FIG. 8.1 and FIG. 8.2, indicia 800 may be disposed on the surface of the spherical puzzle 400 as shown. Indicia representing a recognizable pattern such as the continents and oceans may be disposed on the eight triangular surface pieces 430 together with longitudinal and latitudinal lines. The outside body portions 426*a* of each rectangular surface piece 425 may be divided into three relief sections 810. Indicia disposed on the relief sections 810 of an equatorial circumferential band 820 may represent the zodiac with twelve constellations. Indicia on the remaining eight rectangular surface pieces 425 may represent the planets of the solar system. Indicia on the square surface pieces 420 of the equatorial circumferential band may represent the sun and moon in full and crescent shapes. Indicia on the remaining square surface pieces 420 may represent the north and south poles.

The sliding shell mechanism in accordance the invention provides a spherical puzzle 400 having a hollow interior portion 900 as shown in FIG. 9.1. The hollow interior portion 900 may be utilized to house electronic components such as a battery 905 and a support structure 910. Support structure 910 may be attached to two opposing square surface pieces 420 at the inside body portions 422*b* thereof to provide support for the battery 905, an electronic circuit 907 and a control device such as a switch 915 and a push button 917. LEDs 920 and other electronic devices may be disposed in the rectangular surface pieces 425 as shown in FIG. 9.3.

The inside body portions 422*b* and 426*b* may include a moveable bus 925 having positive and negative leads as shown in FIG. 9.4. Eight contact points 930 may be provided on edges of the rectangular surface pieces 425 and the triangular surface pieces 430. Contact points 930 may be wired to the moveable bus 925 in such manner that certain configurations of the surface pieces of the spherical puzzle 400 according to certain contact codes 922 may cause LEDs 920 to be energized. Thus for example, contact code 25 provides for power to LED 920 in the case where contacts 2 and 5 of triangular surface piece 430 make contact with contacts 2 and 5 of rectangular surface piece 425. One skilled in the art will appreciate that a plurality of such contact codes are possible. Furthermore, the moveable bus 925 may be configured to maintain its structure and provide for electrical continuity with rotation of the puzzle 400.

A fourth preferred embodiment of the invention is shown in FIGS. 10.1, 10.2, 10.3, 10.4 and 10.5. In this embodiment circumferential bands are hidden within the structure of a spherical puzzle 1000. Circumferential bands may include circumferential bands 1005, 1010 and 1015. With particular reference to FIGS. 10.3, 10.4 and 10.5, the spherical puzzle 1000 may be comprised of a flanged triangular surface piece 1020 which includes a body portion 1022 and a surrounding flange 1025 including flange portions 1025*a*, 1025*b* and 1025*c*. Seven slotted triangular surface pieces 1030 may include three slot portions 1033*a*, 1033*b* and 1033*c* sized and configured to alternately receive flange portions 1025*a*, 1025*b*, 1025*c* and a portion of three square pieces 1035 and nine rectangular pieces 1040.

The circumferential bands 1005, 1010 and 1015 may include two square pieces 1035 and three rectangular pieces 1040. The flange portions 1025*a*, 1025*b* and 1025*c* provide the equivalent of a fourth rectangular piece and the third and fourth square pieces to each circumferential band 1005, 1010 and 1015 and also a means by which the circumferential bands 1005, 1010 and 1015 maintain their symmetry with rotation of hemispherical surfaces formed by groupings of four triangular surface pieces.

Surface indicia may be provided on the triangular surface piece 1020 and the triangular surface pieces 1030 to form a pattern which may be solved by a player of the spherical puzzle 1000.

With reference to FIG. 11.1, a fifth preferred embodiment of the invention generally designated 1100 may include a cubic embodiment of the hollow spherical puzzle 400. Puzzle 1100 may be thought of as the hollow spherical puzzle 400 having the surfaces of surface pieces 420, 425 and 430 (FIG. 5.1) deformed such that a center of the hollow spherical puzzle 400 is disposed in a hollow center 1150 of the puzzle 1100 with the deformed surfaces comprising the surfaces of the cubic puzzle 1100.

Utilizing this analogy and with reference to FIG. 11.2, rectangular surface piece 425 may have its outside body portion 426*a* deformed to form an edge element 1110 of the puzzle 1100. Twelve edge elements 1110, of which four (1110*a*, 1110*b*, 1110*c* and 1110*d*) are shown in FIG. 11.1, may be disposed intermediate eight vertex elements 1120 (FIG. 11.3). Vertex elements 1120 are equivalent to triangular surface pieces 430 having a deformed outside body portion 432*a*. Vertex elements 1120*a*, 1120*b* and 1120*c* are shown in FIG. 11.1. To complete the puzzle 1100, six side elements 1130 (FIG. 11.4) equivalent to square surface pieces 420 having a deformed outside body portion 422*a* may be disposed in a center position of each of six surfaces of the puzzle 1100. Three side elements 1130*a*, 1130*b* and 1130*c* are shown in FIG. 11.1.

With reference to FIG. 11.2, edge element 1110 may include opposed slot portions 1112*a* and 1112*b* and opposed flange portions 1113*a* and 1113*b*. Vertex element 1120 may include slot portions 1122*a*, 1122*b* and 1122*c* (FIG. 11.3). Side element 1130 may include a flange portion formed therearound including four flange portions, two of which are shown in FIG. 11.4 as 1132*a* and 1132*b*. One skilled in the art will recognize this arrangement of slots and flanges as equivalent to the sliding shell mechanism of spherical puzzle 400.

The present invention overcomes the disadvantages of the prior art by providing a sliding shell mechanism which provides a hollow spherical puzzle. The hollow portion of the spherical puzzle may be used to house electronic components. Additionally embodiments of the invention provide a means by which the components of the hollow spherical puzzle may be assembled and disassembled. The spherical shape of the embodiments of the invention further provide for a system of slots and flanges which advantageously maintain the shape of the spherical structures. Pressure exerted by the flanges in the slots prevent the easy disassembly of the spherical puzzles and enable the finger key lock system as described.

The foregoing description of the embodiments of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

I claim:

1. A sliding shell mechanism comprising:

three circumferential bands, each circumferential band including two square pieces and three rectangular pieces;

a flanged triangular surface piece including a body portion and a surrounding flange having three flange portions, each flange portion being geometrically equivalent to two square pieces and one rectangular piece and, together with the two square pieces and three rectangular pieces, forming one of the three circumferential bands;

seven slotted triangular surface pieces, each of the seven slotted triangular surface pieces including three slot portions sized and configured to receive portions of the three circumferential bands; and wherein each flange portion maintains the symmetry of each circumferential band with rotation of hemispherical surfaces about the circumferential bands.

2. The sliding shell mechanism of claim 1, further comprising a hollow portion formed inside the flanged triangular surface piece and the seven slotted triangular surface pieces in an assembled configuration.

3. The sliding shell mechanism of claim 1, wherein the flanged triangular surface piece and the seven slotted triangular surface pieces comprise spherically triangular portions.

4. The sliding shell mechanism of claim 3, wherein the spherically triangular portions comprise spherically triangular inside surfaces and deformed outside surfaces.

5. The sliding shell mechanism of claim 1, wherein the flanged triangular surface piece and the seven slotted triangular surface pieces further comprise indicia disposed on outside surfaces thereof, the sliding shell mechanism being disassembleable in a case where the indicia form a recognizable pattern.

* * * * *